US008297528B2

(12) United States Patent
Meyer

(10) Patent No.: US 8,297,528 B2
(45) Date of Patent: Oct. 30, 2012

(54) SPRING-TYPE RAIL MOUNT FOR TRACK SYSTEM

(75) Inventor: Frank Meyer, Stockach (DE)

(73) Assignee: Schwihag AG, Taegerwilen (CH)

( * ) Notice: Subject to any disclaimer, the term of this patent is extended or adjusted under 35 U.S.C. 154(b) by 332 days.

(21) Appl. No.: 12/599,875

(22) PCT Filed: Apr. 30, 2008

(86) PCT No.: PCT/EP2008/003484

§ 371 (c)(1),
(2), (4) Date: Nov. 12, 2009

(87) PCT Pub. No.: WO2008/145240

PCT Pub. Date: Dec. 4, 2008

(65) Prior Publication Data

US 2010/0301126 A1 Dec. 2, 2010

(30) Foreign Application Priority Data

Jun. 1, 2007 (DE) ..... 10 2007 025 708

(51) Int. Cl.
*E01B 9/38* (2006.01)

(52) U.S. Cl. ..... 238/264; 238/303; 238/349

(58) Field of Classification Search ..... 238/264, 238/283, 297, 310, 338, 343, 349, 351, 354, 238/382, 303
See application file for complete search history.

(56) References Cited

U.S. PATENT DOCUMENTS

| | | | | |
|---|---|---|---|---|
| 4,770,343 | A * | 9/1988 | Heim et al. | 238/349 |
| 5,096,119 | A * | 3/1992 | Schultheiss et al. | 238/349 |
| 6,305,613 | B1 | 10/2001 | Igwemezie | 238/287 |
| 6,761,322 | B1 * | 7/2004 | Porrill et al. | 238/264 |
| 7,156,319 | B2 | 1/2007 | Kowalski | 238/265 |
| 7,533,829 | B2 * | 5/2009 | Osler et al. | 238/264 |
| 7,637,438 | B2 * | 12/2009 | Schwiede et al. | 238/349 |
| 7,648,080 | B2 * | 1/2010 | Hohne et al. | 238/351 |
| 7,992,796 | B2 * | 8/2011 | Bednarczyk | 238/264 |
| 2004/0084548 | A1 * | 5/2004 | Schwarzbich | 238/310 |
| 2008/0093472 | A1 * | 4/2008 | Hohne et al. | 238/351 |
| 2008/0105758 | A1 | 5/2008 | Schwiede | 238/349 |
| 2008/0179419 | A1 * | 7/2008 | Vives Clavel | 238/264 |
| 2010/0301126 | A1 * | 12/2010 | Meyer | 238/303 |
| 2011/0068182 | A1 * | 3/2011 | Bosterling et al. | 238/264 |
| 2011/0068183 | A1 * | 3/2011 | Bednarczyk | 238/264 |
| 2011/0204154 | A1 * | 8/2011 | Boesterling et al. | 238/264 |

FOREIGN PATENT DOCUMENTS

EP 1726713 11/2006

* cited by examiner

*Primary Examiner* — Jason C Smith
(74) *Attorney, Agent, or Firm* — Andrew Wilford

(57) ABSTRACT

A rail mount secures a longitudinally extending rail having a foot to a sleeper of a track system. The mount has a rail base plate on the sleeper underneath the rail foot and unitarily formed with a pair of upwardly projecting holders transversely flanking the rail and each formed with at least one vertically throughgoing bore. Respective anchor bolts engaged vertically downward through the bores have heads bearing downward at least indirectly on the respective holders and are seated in the sleeper to hold the base plate down on the sleeper. Respective elastically deformable clips fitted to the holders below the respective anchor-bolt heads bear upwardly on the holders and downwardly on the rail foot to press the rail downwardly toward the sleeper.

19 Claims, 6 Drawing Sheets

SPRING-TYPE RAIL MOUNT FOR TRACK SYSTEM

CROSS REFERENCE TO RELATED APPLICATIONS

This application is the US-national stage of PCT application PCT/EP2008/003484, filed 30 Apr. 2008, published 4 Dec. 2008 as WO2008/145240, and claiming the priority of German patent application 102007025708.4 itself filed 1 Jun. 2007, whose entire disclosures are herewith incorporated by reference.

FIELD OF THE INVENTION

The invention relates to a spring-type rail mount for a track system, having a clip of elastic material, in particular of hardened steel, that is formed as a clamp with torsion legs, that when installed is attached by a holder and anchor bolts extending vertically through the holder to a sleeper, in particular a concrete sleeper, and that exerts a force holding the rail in position, the rail being supported on the sleeper on a rail base plate.

BACKGROUND OF THE INVENTION

With a rail mount of this type known from DE 34 00 110 [U.S. Pat. No. 4,770,343], a clip is used that is provided between a retaining plate and an anchor bolt when installed. The clip here has two legs are designed as torsion elements. The torsion legs have two resilient rod sections extending parallel to each other and connected in one piece by a bight loop forming a brace and essentially curved outward transversely thereto. The two resilient rod sections of the torsion legs are connected via the transverse connecting piece. The two outer resilient rod sections of the torsion legs each have a U-shaped bend spaced behind the transverse connecting piece, which bend is supported with its free end section on the transverse connecting piece, while anchoring parts of the rail mount flanking a bight and each spaced above leading surfaces and provided adjacent the rail foot for the bracing sections of the clip have two support flanges for the torsion legs of the clip and projecting toward opposite sides.

From DE 39 18 091 [U.S. Pat. No. 5,096,119] a rail mount is known, in which sections of the outer legs of clips formed as an epsilon diverge toward the rail foot, increasing the spacing from the inner legs. The free ends of the clip facing toward one another end outside the inner legs. Furthermore, the clip is designed such that in the installed position a bight comes to rest at a short spacing above the rail foot and in a preinstalled position bears with its inside against the shank of the sleeper bolt.

It is known when using clamp-type clips (rail clamps) of this type to provide indirect spring-type rail mounts. Compared to direct elastic rail mounts, such as are known from DE 102 33 784 [U.S. Pat. No. 7,156,139], these have the advantage of a defined and lower prestressing of an elastic intermediate plate lying below the rail foot. However, to prestress the one or more elastic intermediate plates, these indirect elastic rail mounts require two sleeper bolts or through bolts and to brace the clips or rail clamps in addition two clip bolts so that at least four bolts are necessary. This increases not only the number of parts and the expenditure in terms of production and installation of the rail mount, but also the number of trouble sources and inspection points.

Although an indirect spring-type rail mount is known from DE 10 2004 031 632 [US 2008/0093472] that requires only two sleeper bolts or through bolts, they always need to be placed somewhat toward the outside through a bore provided in the holders and the elastic intermediate layer or intermediate layers into the sleeper. They are not located centrally or directly below the clips, but rather under the torsion legs. Installation or removal of the sleeper bolts/through bolts with installed clips is therefore impossible. Apart from the larger installation space necessary for this rail fixing system, a more complex design of the components results, caused for example by the necessary recessing of the screw heads and the load transfer which is unfavorable overall.

OBJECT OF THE INVENTION

The object of the invention is therefore to create a generic, indirect spring-type rail mount without the cited disadvantages that requires components that are less complex in production and less installation space and that permits installation or removal of the anchor bolts or lsleeper bolts/through bolts with the clips installed.

SUMMARY OF THE INVENTION

This object is attained according to the invention in that the rail base plate is formed as one piece with the holders having bores for the anchor bolts provided on its two ends such that on the one hand the clips are held in a positive manner and on the other hand the holders and the respective clips are prestressed against the rail placed with its rail foot between the holders. Because according to the invention the rail foot thus prestresses the holder preferably made of a cast metal or high-strength plastic and above it the clips mounted thereon in a positive manner, the clips received with their torsion legs in the holders no longer impede free access to the anchor bolts. Instead, they can be threaded through or inserted through the clips and the holders centrally from above and can be screwed into the sleeper. Only two anchor bolts are necessary, whose installation is independent of the clips. Nevertheless, it is possible for the two anchor bolts to simultaneously prestress an elastic intermediate plate lying under the rail base plate according to a preferred embodiment of the invention by a defined prestress spacing, independent of the prestressing of the clips.

The compact design of the system achieved furthermore makes it possible for the anchor bolts to be mounted much closer to the rail foot than with all known rail mounts. An optimum, uniformly distributed prestressing or also bracing of the elastic intermediate plate can therefore occur, considering the bracing-force cone that a screw always generates.

According to one embodiment of the invention, a compensating plate that can be inserted between the sleeper and the elastic intermediate plate can be provided. A height adjustment that might be predetermined by installation conditions is thus possible by the thickness of the compensating plate being used. The design can be changed or raised if necessary by additional plates.

According to an advantageous proposal of the invention, at least one intermediate insulation spacer can be fitted in between the rail foot and the holders. The spacing of the two holders determined by the width of the rail foot can thus be varied so that the prestressing of the holders effected via the rail foot is always guaranteed.

When a bushing transferring the prestressing force to the elastic intermediate plate and/or the compensating plate while the anchor bolts are being screwed in according to the prestress spacing is advantageously provided in the bores of the anchor bolts, the defined prestressing can be achieved in this manner by tightening the anchor bolts. Alternatively, adjustment of the prestress spacing is advantageously possible via a defined screw torque of the anchor bolts, i.e. a spacer or bushing is indispensable in this case.

With the rail mount a spring washer is recommended between the screw heads and the holders. This can be made of resilient plastic or it can be formed as a Belleville washer and prevents an abrupt increase in the screw load and thus a pulling out of the plug from the sleeper.

According to one embodiment of the invention, the rail base plate is accommodated between abutment humps of the sleeper and thus fixed in its installed position.

A preferred embodiment of the invention provides that elastic lateral sliding inserts are provided between the abutments and the rail base plate. These inserts are used not only for the exact positioning and transverse force damping and guidance of the deflecting rail base plate, but also for transferring the transverse wee; force or transverse rail force to the abutments with a concrete sleeper formed with the humps.

Advantageous embodiments of the invention provide that the elastic lateral sliding inserts engage with projections in respective recesses of the sleeper and/or the abutment humps. To this end they can be provided with feet extending forward and/or on their outer edges facing toward the abutment humps of the sleeper with at least one engagement projection. The lateral sliding inserts are hereby held longitudinally of the rail.

According to an advantageous proposal of the invention, the elastic lateral sliding inserts are formed with grooves facing toward one another, into which grooves the elastic intermediate plate and/or the compensating plate engages on the outer edges. The lateral sliding inserts are thus additionally held down and cannot be pressed vertically upward out of their installed position.

A further preferred embodiment of the invention provides that the elastic lateral sliding inserts are formed on their upper ends remote from the sleeper with projecting shoulders absorbing the forces longitudinally of the rail from the rail base plate and transferring them to the sleeper.

BRIEF DESCRIPTION OF THE DRAWING

Further details and features of the invention are seen in the claims and the following description of embodiments of the invention shown in the drawings. Therein:

DETAILED DESCRIPTION

Figure 1:
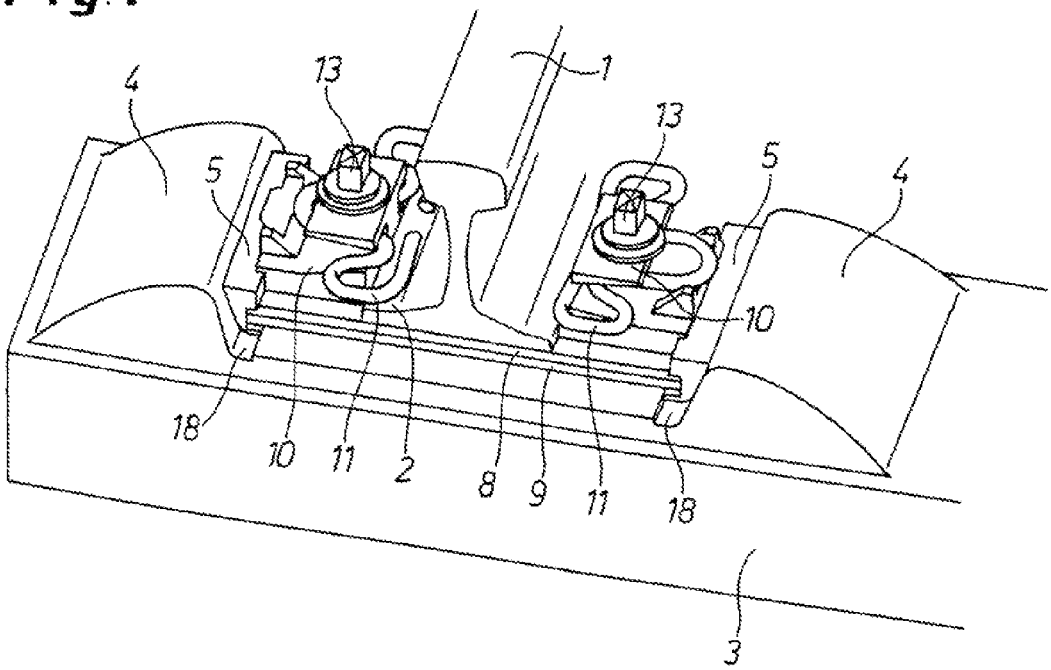
FIG. 1 is a perspective overall view seen longitudinally of a rail of a fully installed indirect spring-type rail mount.
Figure 2:
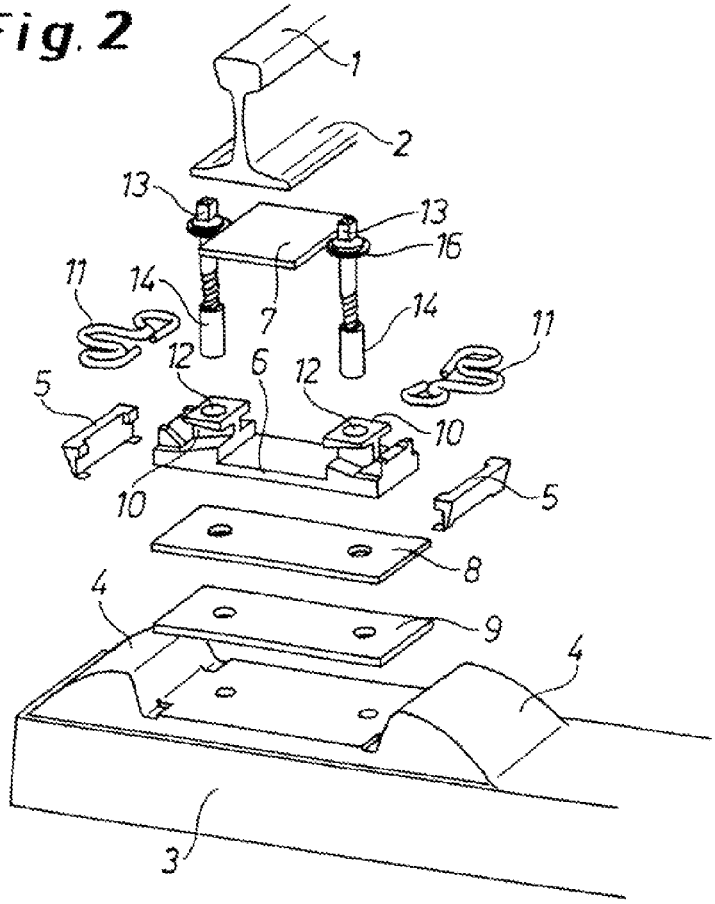
FIG. 2 is an exploded view of the rail mount according to FIG. 1.
Figure 9:
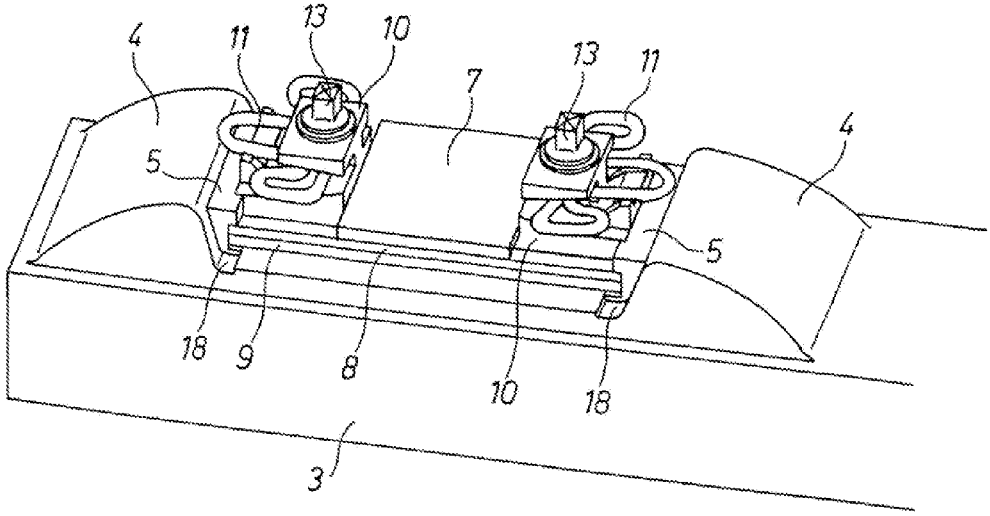
FIG. 9 shows the sleeper of FIG. 8 partially assembled but before the inwardly directed displacement of the clips held in the holders in a positive manner, and thus prior to final installation according to FIG. 1.
Figure 12:
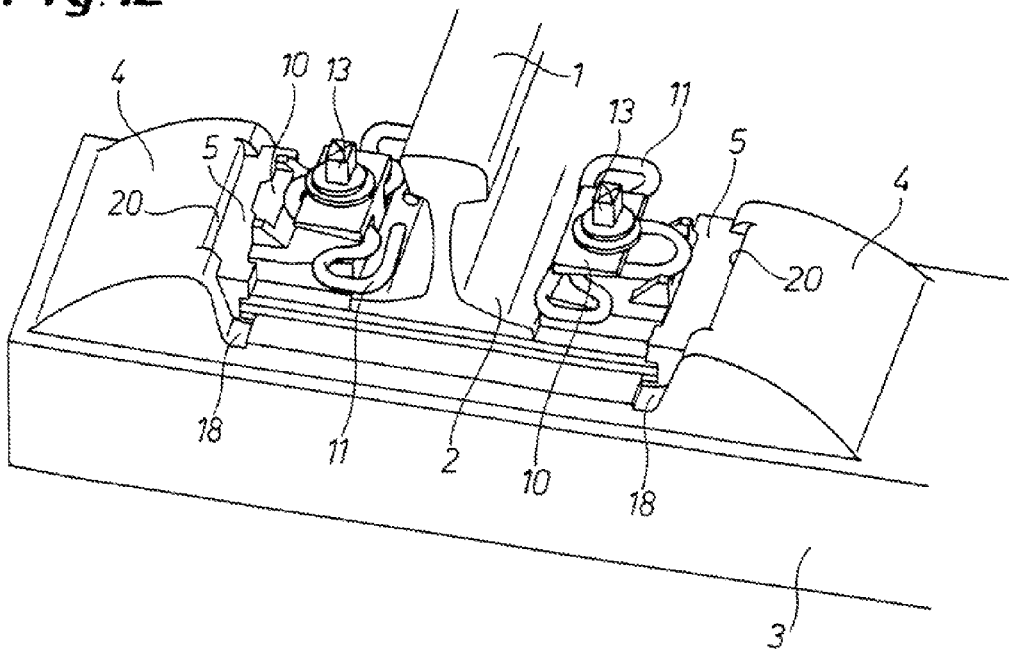
FIG. 12 is a view like FIG. 1 of a fully installed rail mount with the sleeper of FIG. 10 and lateral sliding inserts of FIG. 11.

FIGS. 1 and 12 show an indirect spring-type rail mount for a track system, with an exploded view of the individual parts in FIG. 2. A rail 1 is here attached with its foot 2 to a sleeper 3. The sleeper 3 has two abutment humps 4 spaced apart from one another, with lateral sliding inserts 5 flanking a rail base plate 6 on which the foot 2 of the rail 1 rests, if necessary with the interposition of a spacer plate 7 (see FIG. 9). In the illustrated embodiment a resilient intermediate plate 8 and below it, bearing directly on the sleeper 3, a compensating plate 9 are provided under the rail base plate 6.

Figure 4:
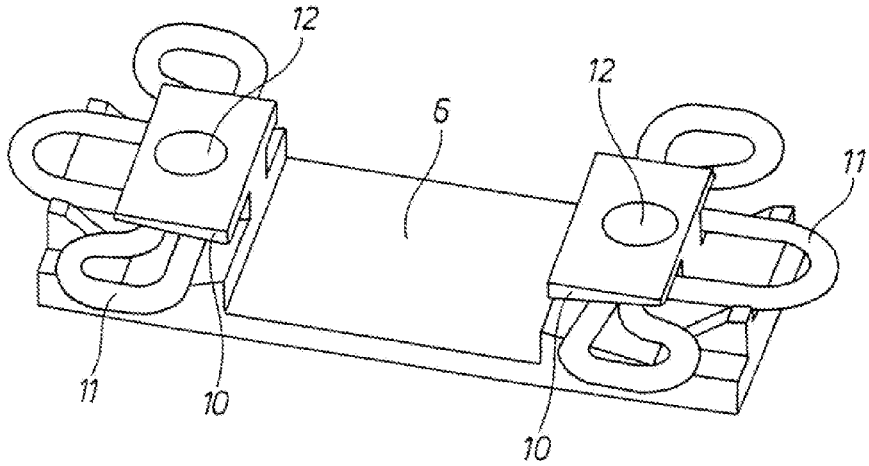
FIG. 4 is a perspective top view of a detail of the rail mount with a rail base plate formed as one piece with holders on the ends and clips held in a positive manner in the holders.

The rail base plate 6 shown in detail in FIG. 4 is formed as one piece with holders 10 in which clamping clips 11 are held in a positive manner, the clips 11 being fitted to the holders 10 from the outside inward until they come to rest with their ends facing toward the rail 1 and resting on the rail foot 2, as shown in the left half of the view in FIGS. 1 and 12. The rail 1 or the foot 2 thereof fits snugly between the holders 10 with the clips 11 prestressed in the holders 10 through the action of the rail 1 or of the rail foot 2. To vary the transverse spacing between the holders 10 and to adjust to the actual size of the rail foot 2, intermediate insulation spacers (not shown in the figures) can be fitted in or placed in between the outer edges of the rail foot 2 and the holders 10.

The holders 10 are provided with throughgoing bores 12 that when installed are aligned with bores in the elastic intermediate plate 8, the compensating plate 9, and the sleeper 3. Since the clips 11 are always under prestress in the holders 10, the bores 12 are freely accessible from outside so that anchor bolts 13, only two of which are necessary, can be inserted through the holders 10 and screwed into the sleeper 3.

Figure 3:
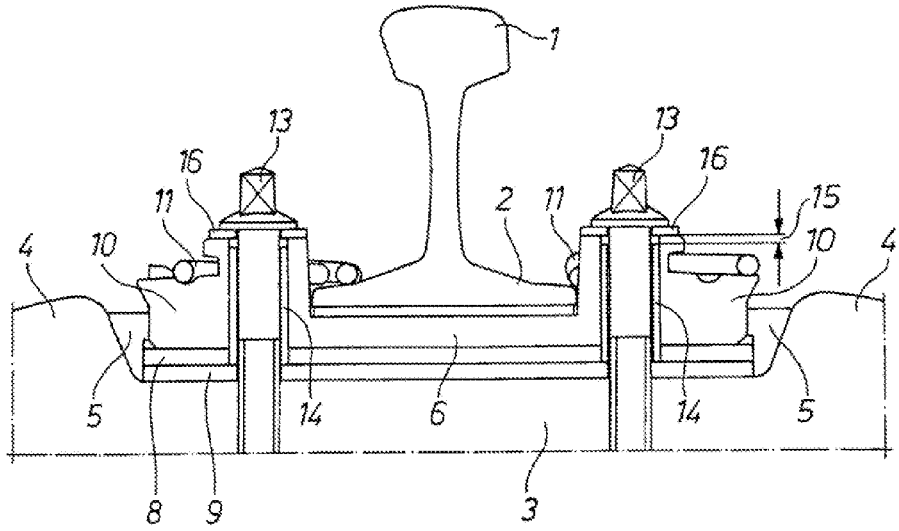
FIG. 3 is a cross section through the rail mount according to FIG. 1.

Screwing in the anchor bolts 13 prestresses the spring clips 11. To this end, a spacer bushing 14 is provided in each of the bores 12 of the holders 10 and bears on the compensating plate 9 as can be seen in FIG. 3. When tightening the anchor bolts 13, the elastic intermediate plate 8 can be prestressed to a defined extent by a prestress spacing 15. An abrupt increase in screw torque is avoided by spring washers 16 fitted under the heads of the anchor bolts 13.

Figure 5:
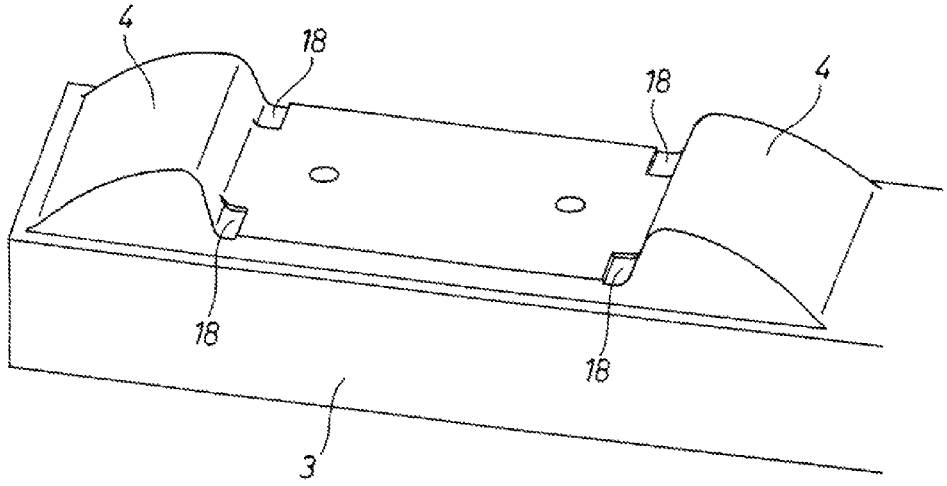
FIG. 5 is a perspective overall view as a detail of the rail mount of a sleeper formed with abutment humps.
Figure 6:
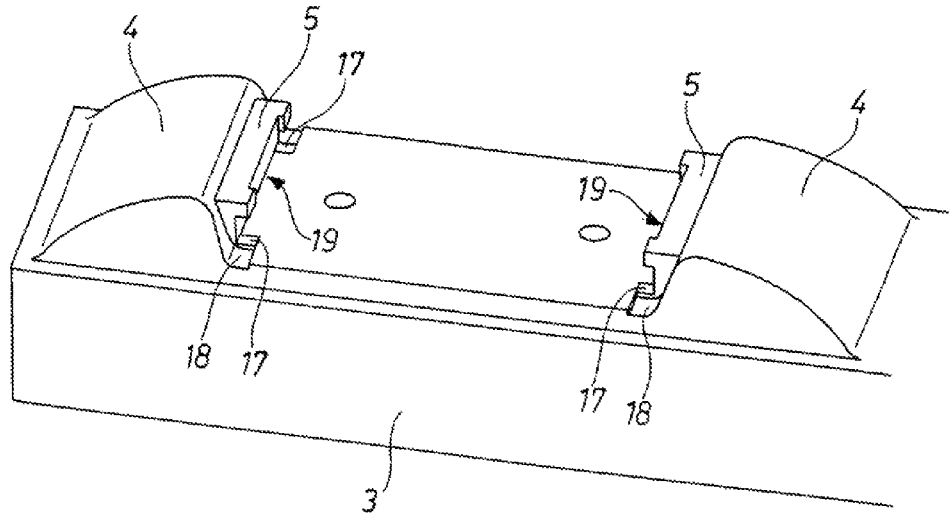
FIG. 6 shows the sleeper according to FIG. 5 with lateral sliding inserts inserted in recesses and braced from behind against the abutment humps.
Figure 7:
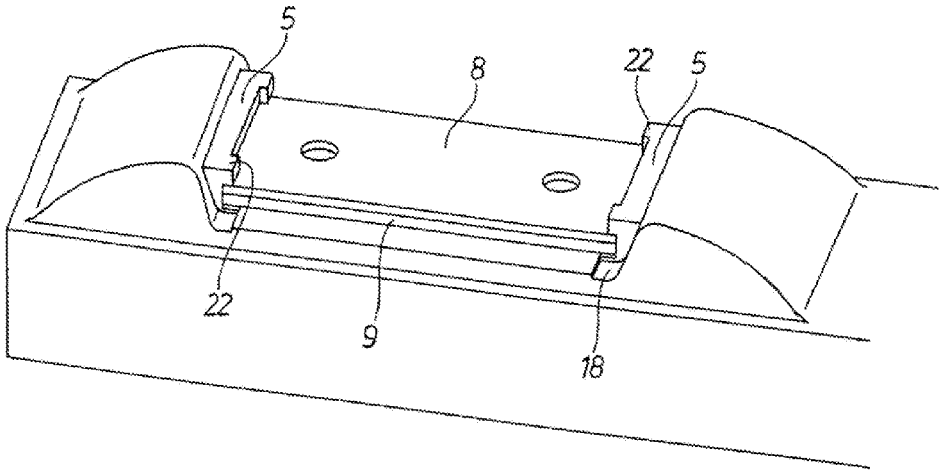
FIG. 7 shows the sleeper of FIG. 6 with a compensating plate and an elastic intermediate plate whose outer ends fit into the lateral sliding inserts.
Figure 8:
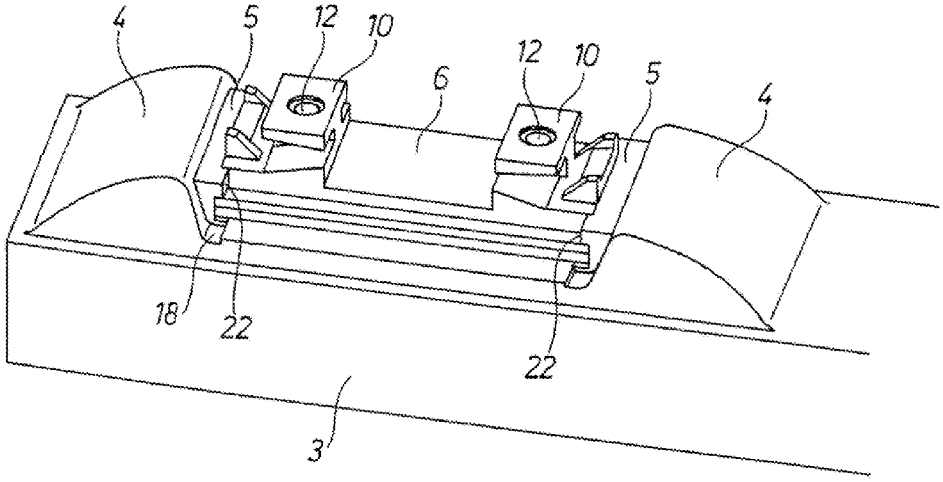
FIG. 8 shows the sleeper of FIG. 7 partially assembled with a rail base plate on the plate assembly.
Figure 10:
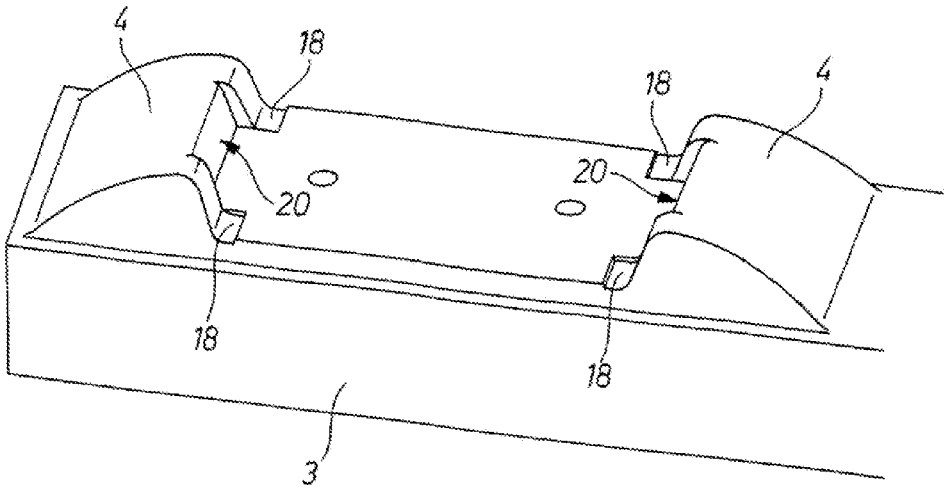
FIG. 10 is a perspective overall plan view of a detail of another embodiment of a sleeper, which with respect to FIG. 5 is also formed with recesses for the lateral sliding inserts in its abutment humps.
Figure 11:
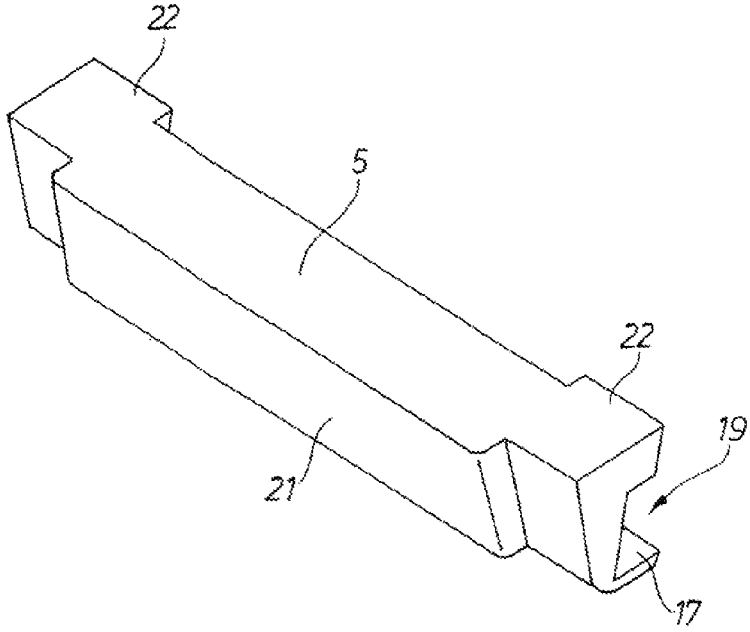
FIG. 11 is a perspective overall top view of a detail of a lateral sliding insert for the sleeper of FIG. 10.

The lateral sliding inserts 5 inserted between the abutment humps 4 and the rail base plate 6 are formed with feet 17 and engage therewith in recesses 18 of the sleeper 3 (see FIGS. 5 and 6). In addition, grooves 19 formed in the elastic lateral sliding inserts 5, when installed, face one another and receive outer edges of the elastic intermediate plate 8 and the compensating plate 9 so that the lateral sliding inserts 5 are pressed down and held in their installed position. Furthermore in this embodiment of the sleeper 3, recesses or indentations 20 formed in the abutment humps 4 according to FIG. 10 mate with projections 21 on their outer edges as shown in FIG. 11. Shoulders 22 formed on the upper ends of the lateral sliding inserts 5 absorb forces exerted by the rail base plate 6 longitudinally of the rail 1 and transmit them to the sleeper 3.

The invention claimed is:

1. A rail mount for securing a longitudinally extending rail having a foot to a sleeper of a track system, the mount comprising: a rail base plate on the sleeper underneath the rail foot of a one piece configuration formed unitarily with a pair of upwardly projecting holders transversely flanking the rail and each formed with at least one vertically throughgoing bore; respective anchor bolts engaged vertically downward through the bores, having heads bearing downward on the respective holders, and seated in the sleeper to hold the base plate down on the sleeper; and respective elastically deformable clips fitted to the holders below the respective anchor-bolt heads and bearing upwardly on the holders and downwardly on the rail foot to press the rail is downwardly toward the sleeper.

2. The rail mount according to claim 1, further comprising at least one intermediate insulation spacer that can be fitted in between the rail foot and the holders.

3. The rail mount according to claim 1, further comprising an elastic intermediate plate provided below the rail base plate and is prestressed by a prestress spacing while the anchor bolts are being screwed independently of the prestressing of the clips.

4. The rail mount according to claim 3, further comprising a compensating plate that can be inserted between the sleeper and the elastic intermediate plate.

5. The rail mount according to claim 3, further comprising a respective bushing in each of the bores of the anchor bolts and transferring the prestressing force to the elastic intermediate plate and/or the compensating plate while the anchor bolt are being screwed in according to the prestress spacing.

6. The rail mount according to claim 3 wherein the prestress spacing is adjusted by a defined screw torque of the anchor bolts.

7. The rail mount according to claim 3, further comprising respective spring washers between screw heads of the anchor bolts and the respective holders.

8. The rail mount defined in claim 1 wherein the sleeper is formed with a pair of transversely spaced abutment humps between which the base plate fits.

9. The rail mount defined in claim 1, further comprising respective spring washers engaged upwardly with heads of the anchor bolts and downwardly with the base plate.

10. The rail mount defined in claim 1 wherein each clip is formed of a single piece of steel wire.

11. The rail mount defined in claim 10, wherein the bolts pass through the respective clips.

12. A rail mount for securing a longitudinally extending rail having a foot to a sleeper of a track system, the mount comprising:

a rail base plate on the sleeper underneath the rail foot and unitarily formed with a pair of upwardly projecting holders transversely flanking the rail and each formed with at least one vertically throughgoing bore;

respective anchor bolts engaged vertically downward through the bores and seated in the sleeper to hold the base plate down on the sleeper;

respective elastically deformable clips bearing upwardly on the holders and downwardly on the rail foot to press the rail downwardly toward the sleeper; and respective elastic lateral sliding inserts between the abutment humps and respective transverse ends of the rail base plate.

13. The rail mount according to claim 12 wherein the elastic lateral sliding inserts engage with projecting feet in recesses of the sleeper or the abutment humps.

14. The rail mount according to claim 12 wherein the elastic lateral sliding inserts are formed with grooves facing each other and into which outer edges of an elastic intermediate plate or a compensating plate engage.

15. The rail mount according to claim 12 wherein the elastic lateral sliding inserts are formed on their upper ends remote from the sleeper with shoulders absorbing the forces longitudinally of the rail from the rail base plate and transferring them to the sleeper.

16. The rail mount according to claim 12 wherein the lateral sliding inserts are provided with at least one engagement projection on their outer edges facing toward the abutment humps of the sleeper.

17. A rail mount for securing a longitudinally extending rail having a foot to a track-system sleeper having a pair of transversely spaced abutment humps, the mount comprising:

a rail base plate between the humps, on the sleeper, underneath the rail foot, and unitarily formed with a pair of upwardly projecting holders transversely flanking the rail and each formed with at least one vertically throughgoing bore;

respective anchor bolts engaged vertically downward through the bores and seated in the sleeper to hold the base plate down on the sleeper;

respective elastically deformable clips bearing upwardly on the holders and downwardly on the rail foot to press the rail downwardly toward the sleeper;

respective inserts between each of the humps and a respective outer edge of the base plate; and transversely interengaging complementary formations on the inserts, the base-plate outer edges, and sleeper engaging transversely in each other and preventing relative longitudinal movement of the sleeper, inserts, and base plate.

18. The rail mount defined in claim 17 wherein the formations include a downwardly projecting foot on the insert, an upwardly open recess on the sleeper receiving the foot, and shoulders on the insert longitudinally flanking the base plate.

19. The rail mount defined in claim 17, further comprising at least one spacer or insulation plate between the base plate and the sleeper, the inserts each having a transversely inwardly open groove in which a respective outer end of the spacer or insulation plate is received.

* * * * *